US009595236B2

(12) United States Patent
Kim et al.

(10) Patent No.: US 9,595,236 B2
(45) Date of Patent: Mar. 14, 2017

(54) DATA DRIVER AND DISPLAY APPARATUS INCLUDING THE SAME

(71) Applicant: Samsung Display Co., Ltd., Yongin (KR)

(72) Inventors: Jinpil Kim, Suwon-si (KR); Jai-Hyun Koh, Hwaseong-si (KR); Ik Soo Lee, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 38 days.

(21) Appl. No.: 14/711,033

(22) Filed: May 13, 2015

(65) Prior Publication Data

US 2016/0225335 A1 Aug. 4, 2016

(30) Foreign Application Priority Data

Jan. 30, 2015 (KR) ..... 10-2015-0015344

(51) Int. Cl.
*G09G 3/36* (2006.01)

(52) U.S. Cl.
CPC ..... *G09G 3/3685* (2013.01); *G09G 3/3614* (2013.01); *G09G 2300/0452* (2013.01); *G09G 2310/027* (2013.01)

(58) Field of Classification Search
CPC ..... G09G 3/3614; G09G 2300/0823; G09G 2310/0254
See application file for complete search history.

(56) References Cited

U.S. PATENT DOCUMENTS

| | | | | |
|---|---|---|---|---|
| 7,688,301 | B2 | 3/2010 | Lee et al. | |
| 7,746,334 | B2 | 6/2010 | Lee et al. | |
| 7,893,910 | B2 * | 2/2011 | Feng | G09G 3/3614 345/96 |
| 8,456,403 | B2 | 6/2013 | Jang et al. | |
| 2004/0178981 | A1 * | 9/2004 | Asada | G09G 3/3614 345/96 |
| 2006/0028426 | A1 * | 2/2006 | Hiratsuka | G09G 3/3614 345/103 |
| 2008/0158128 | A1 * | 7/2008 | Feng | G09G 3/3614 345/96 |
| 2008/0259016 | A1 * | 10/2008 | Tanaka | G09G 3/3688 345/90 |

(Continued)

FOREIGN PATENT DOCUMENTS

| | | |
|---|---|---|
| KR | 10-2005-0112953 | 12/2005 |
| KR | 10-2011-0011309 | 2/2011 |

(Continued)

*Primary Examiner* — Kevin M Nguyen
(74) *Attorney, Agent, or Firm* — H.C. Park & Associates, PLC

(57) ABSTRACT

A data driver for a display includes: a polarity signal generator outputting polarity control signals for setting polarity patterns of data voltages such that pixels have the same polarity inversion pattern for every 2h number of pixels (where h is a natural number) in each pixel row defined by pixels that are arranged on the same row and have the same polarity inversion pattern for every 2k number of pixel rows (where k is a natural number) in a column direction; and a data voltage generator determining polarities of the data voltages in response to the polarity control signal to provide the determined polarities of the data voltages to the pixels.

17 Claims, 6 Drawing Sheets

(56) References Cited

U.S. PATENT DOCUMENTS

| | | | | |
|---|---|---|---|---|
| 2013/0127930 | A1* | 5/2013 | Nishio | G09G 3/3688 345/690 |
| 2013/0271439 | A1 | 10/2013 | Kato et al. | |
| 2013/0293520 | A1 | 11/2013 | Hsiao et al. | |

FOREIGN PATENT DOCUMENTS

| | | |
|---|---|---|
| KR | 10-1061631 | 9/2011 |
| KR | 10-1389205 | 4/2014 |

* cited by examiner

DATA DRIVER AND DISPLAY APPARATUS INCLUDING THE SAME

CROSS-REFERENCE TO RELATED APPLICATION

This application claims priority from and the benefit of Korean Patent Application No. 10-2015-0015344, filed on Jan. 30, 2015, which is hereby incorporated by reference for all purposes as if fully set forth herein.

BACKGROUND

Field

Exemplary embodiments of the invention relate to a data driver and a display apparatus including the same, and more particularly, to a data driver capable of easily setting polarities of data voltages and a display apparatus including the same.

Discussion of the Background

In a liquid crystal display apparatus, an image is displayed by forming an electric field on a liquid crystal layer disposed between two substrates to change an alignment state of liquid crystal molecules such that light transmittance is adjusted.

Methods of driving the liquid crystal display apparatus may be classified into a line inversion method, a column inversion method, and a dot inversion method according to a phase of a data voltage applied to a data line.

The line inversion method is a method of inverting a phase of image data applied to the data line for every pixel row to apply the image data. The column inversion method is a method of inverting the phase of the image data applied to the data line for every pixel column to apply the image data. The dot inversion method is a method of inverting the phase of the image data applied to the data line for every pixel row and every pixel column to apply the image data.

Generally, a display apparatus expresses a color by using three primary colors of red, blue, and green. Therefore, a display panel is provided with sub pixels respectively corresponding to red, blue, and green. Recently, a display apparatus displaying a color by using red, blue, green, and a primary color has been proposed.

The primary color may be a color other than red, blue, and green, for example, magenta, cyan, yellow, or white, or may include two colors or more. Also, in order to improve the luminance of a displayed image, a technology including red, blue, green, and white sub pixels has been developed. Red, blue, and green image signals supplied from an external source are converted into red, blue, green, and white data signals and are then supplied to the display panel.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments provide a data driver capable of easily setting polarities of data voltages and an apparatus including the same.

Additional aspects will be set forth in the detailed description which follows, and, in part, will be apparent from the disclosure, or may be learned by practice of the inventive concept.

An exemplary embodiment discloses a data driver that includes: a polarity signal generator outputting polarity control signals for setting polarity patterns of data voltages such that pixels have the same polarity inversion pattern for every 2h number of pixels (where h is a natural number) in each pixel row defined by pixels that are in the same row and have the same polarity inversion pattern for every 2k number of pixel rows (where k is a natural number) in a column direction; and a data voltage generator determining polarities of the data voltages in response to the polarity control signal to provide the determined polarities of the data voltages to the pixels.

An exemplary embodiment also discloses a display apparatus including: a plurality of pixels receiving data voltages in response to gate signals to display an image; a gate driver supplying the gate signals to the pixels; and a data driver supplying the data voltages to the pixels. The data driver includes: a polarity signal generator outputting polarity control signals for setting polarity patterns of data voltages such that pixels have the same polarity inversion pattern for every 2h number of pixels (where h is a natural number) in each pixel row defined by pixels that are in the same row and have the same polarity inversion pattern for every 2k number of pixel rows (where k is a natural number) in a column direction; and a data voltage generator determining polarities of the data voltages in response to the polarity control signal to provide the determined polarities of the data voltages to the pixels.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
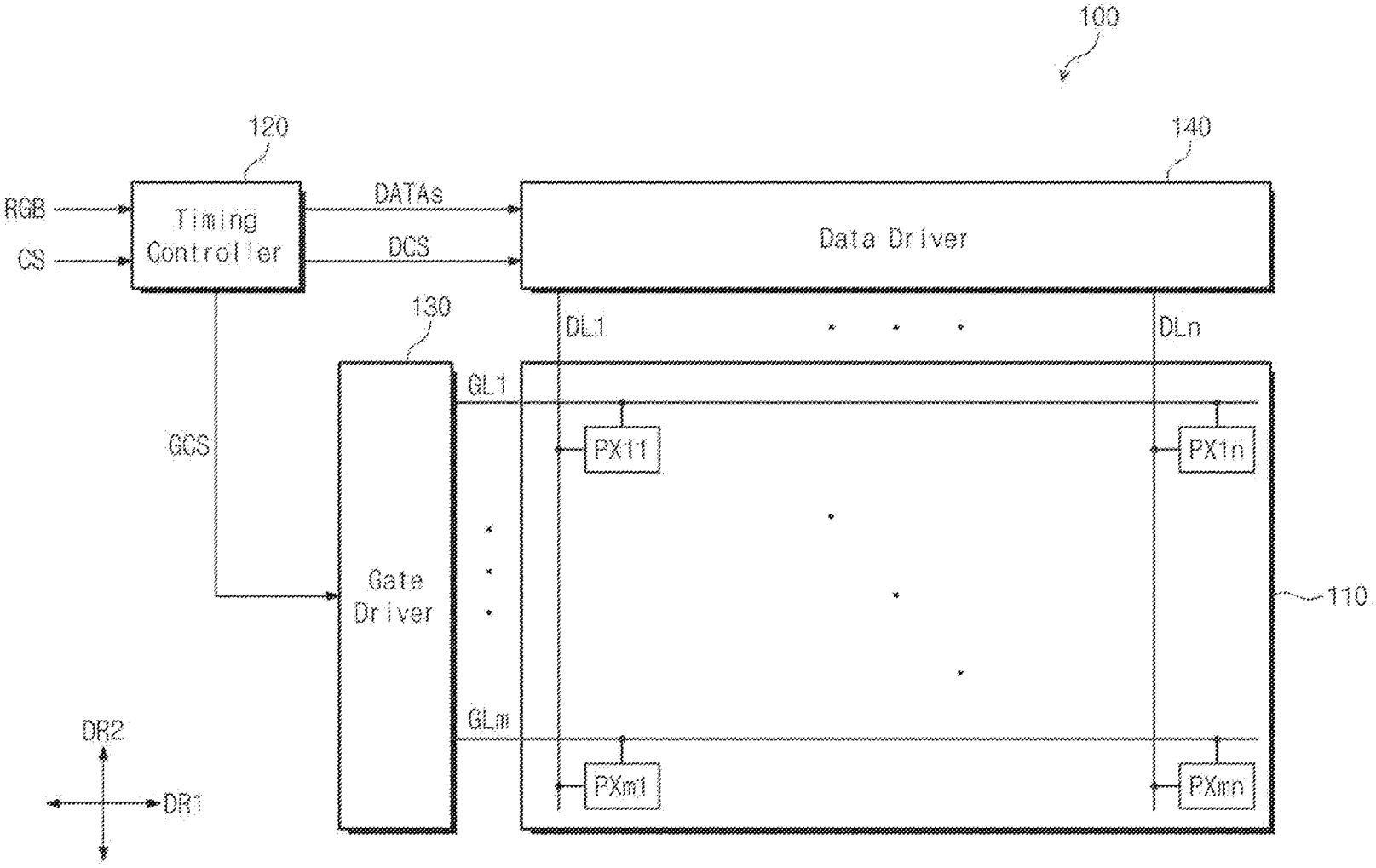
FIG. 1 is a block diagram showing a display apparatus according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram showing a display apparatus according to an exemplary embodiment.

Referring to FIG. 1, a display apparatus 100 according to an exemplary embodiment includes a display panel 110, a timing controller 120, a gate driver 130, and a data driver 140.

The display panel 110 includes a plurality of gate lines GL1 to GLm, a plurality of data lines DL1 to DLn, and a plurality of pixels PX11 to PXnm.

The gate lines GL1 to GLm extend in a first direction DR1 to be connected to the gate driver 130. The data lines DL1 to DLn extend in a second direction DR2 intersecting with the first direction DR1 to be connected to the data driver 140. The characters "m" and "n" denote natural numbers. The first direction DR1 may be a row direction. The second direction DR2 may be a column direction.

The pixels PX11 to PXms are disposed on regions defined by the gate lines GL1 to GLm and the data lines DL1 to DLn intersecting with each other. Therefore, the pixels PX11 to PXnm may be arranged in a matrix configuration having m number of rows and n number of columns.

The pixels PX11 to PXmm are connected to the gate lines GL1 to GLm and the data lines DL1 to DLn. Each of pixels PX11 to PXmn may display one of primary colors. The primary color may include red, green, blue, and white colors. The primary color is not limited thereto, but may include various colors such as yellow, cyan, and magenta.

The timing controller 120 receives image signals RGB and a control signal CS from the outside (for example, a system board). The timing controller 120 converts a data format of the image signals RGB to a data format appropriate to an interface between the timing controller 120 and the data driver 140. The timing controller 120 applies a plurality of pieces of data DATAs having the converted data format to the data driver 140.

The timing controller 120 generates a gate control signal GCS and a data control signal DCS in response to the control signal CS. The gate control signal GCS is a control signal for controlling an operation timing of the gate driver 130. The data control signal DCS is a control signal for controlling an operation timing of the data driver 140.

The timing controller 120 supplies the gate control signal GCS to the gate driver 130. The timing controller 120 supplies the data control signal DCS to the data driver 140.

The gate driver 130 generates and outputs gate signals in response to the gate control signal GCS. The gate driver 130 may sequentially output the gate signals. The gate signals are supplied to the pixels PX11 to PXmn in a row unit through the gate lines GL1 to GLm.

The data driver 140 generates and outputs analog data voltages corresponding to the plurality of pieces of image data DATAs in response to the data control signal DCS. The data voltages are supplied to the pixels PX11 to PXmn through the date lines DL1 to DLn. The polarities of the data voltages are determined by the data control signal DCS.

The polarities of the data voltages may be set such that the data voltages have the same polarity inversion pattern for every 2h number of pixels in each pixel row (in the DR1 direction). The number "h" is a natural number. The number "2h" is smaller than "n". The number "n" is an even number, and may be set to a value divided by "2h".

Also, the polarities of the data voltages may be set such that the data voltages have the same polarity inversion pattern for every 2k number of pixel rows in a column direction (or the second direction DR2). The number "k" is a natural number. The "2k" is smaller than "m". The number "m" is an even number, and may be set to a value divided by "2k".

Operations with respect to the polarity inversion patterns of the data voltages will be described in detail below.

The pixels PX11 to PXmn receive the data voltages through the data lines DL1 to DLn in response to the gate signals received through the gate lines GL1 to GLm. The pixels PX11 to PXmn may display gradation corresponding to the data voltages to display an image.

The timing controller 120 may be mounted on a data circuit board (not shown) in the form of an integrated circuit chip and be connected to the gate driver 130 and the data driver 140.

Each of the gate driver 130 and the data driver 140 includes a plurality of driver chips mounted on a flexible printed circuit board (not shown), and may be connected to the display panel 110 in the form of a tape carrier package (TCP).

The gate driver 130 and the data driver 140 are not limited thereto, but may include the plurality of driver chips and be mounted on the display panel 110 in a chip on glass (COG) method. Also, the gate driver 130 may be formed concurrently with transistors of pixels PX11 to PXmn to be mounted on the display panel 110 in an amorphous silicon TFT Gate driver circuit (ASG).

Figure 2:
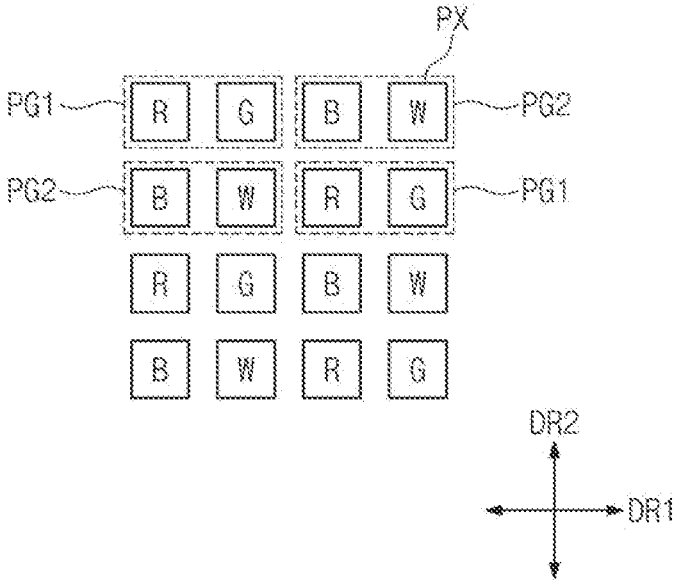
FIG. 2 is a view illustrating an exemplary arrangement of pixels illustrated in FIG. 1.

FIG. 2 is a view illustrating an exemplary arrangement of pixels illustrated in FIG. 1.

FIG. 2 shows pixels that are disposed in four rows and four columns for convenience of description, but the number of pixels is not limited thereto.

Referring to FIG. 2, pixels PX include a plurality of red pixels R, a plurality of green pixels G, a plurality of blue pixels B, and a plurality of white pixels W respectively displaying a red color, a green color, a blue color, and a white color. The pixels PX are not limited thereto, but may further include yellow pixels, cyan pixels, and magenta pixels respectively displaying a yellow color, a cyan color, and a magenta color.

The pixels PX may be grouped into first pixel groups PG1 and second pixel groups PG2. The first pixel groups PG1 and the second pixel groups PG2 may be alternately disposed in the first direction DR1 and in the second direction DR2. Arrangement configurations of the first and second groups of pixels PG1 and PG2 are not limited to the arrangement configurations of the first and second groups of pixels PG1 and PG2 illustrated in FIG. 2, but may be variously set.

For example, the same pixel groups may be disposed in the same row, and the first pixel groups PG1 and the second pixel groups PG2 may be repeatedly and alternately disposed in the second direction DR2. Also, the same pixel groups may be disposed in the same column, and the first pixel groups PG1 and the second pixel groups PG2 may be repeatedly and alternately disposed in the first direction DR1.

The first pixel groups PG1 and the second pixel groups PG2 may include 2L pixels PX, respectively. The variable "L" is a natural number. That is, each of the first pixel groups PG1 and the second pixel groups PG2 includes the even number of pixels PX. In an exemplarily embodiment, L may be one, and in this case, as illustrated FIG. 2, each of the first pixel groups PG1 and the second pixel groups PG2 may include two pixels PX.

The first pixel groups PG1 may include two pixels of red pixel R, green pixel G, blue pixel B, and white pixel W, and the second pixel groups PG2 may include the remaining two pixels of the red pixel R, the green pixel G, the blue pixel B, and the white pixel W. That is, the first pixel groups PG1 and the second pixel groups PG2 may display different colors.

For example, as illustrated in FIG. 2, each of the first pixel groups PG1 may include the red pixel R and the green pixel G. Each of the second pixel groups PG2 may include the blue pixel B and the white pixel W. Arrangement configurations of the pixels PX are not limited to the arrangement configurations illustrated in FIG. 2, but may be variously set.

For example, each of the first pixel groups PG1 may include the red pixel R and the blue pixel B, and each of the second pixel groups PG2 may include the green pixel G and the white pixel W. Also, each of the first pixel groups PG1 may include the red pixel R and the white pixel W, and each of the second pixel groups PG2 may include the green pixel G and the blue pixel B.

Figure 3:
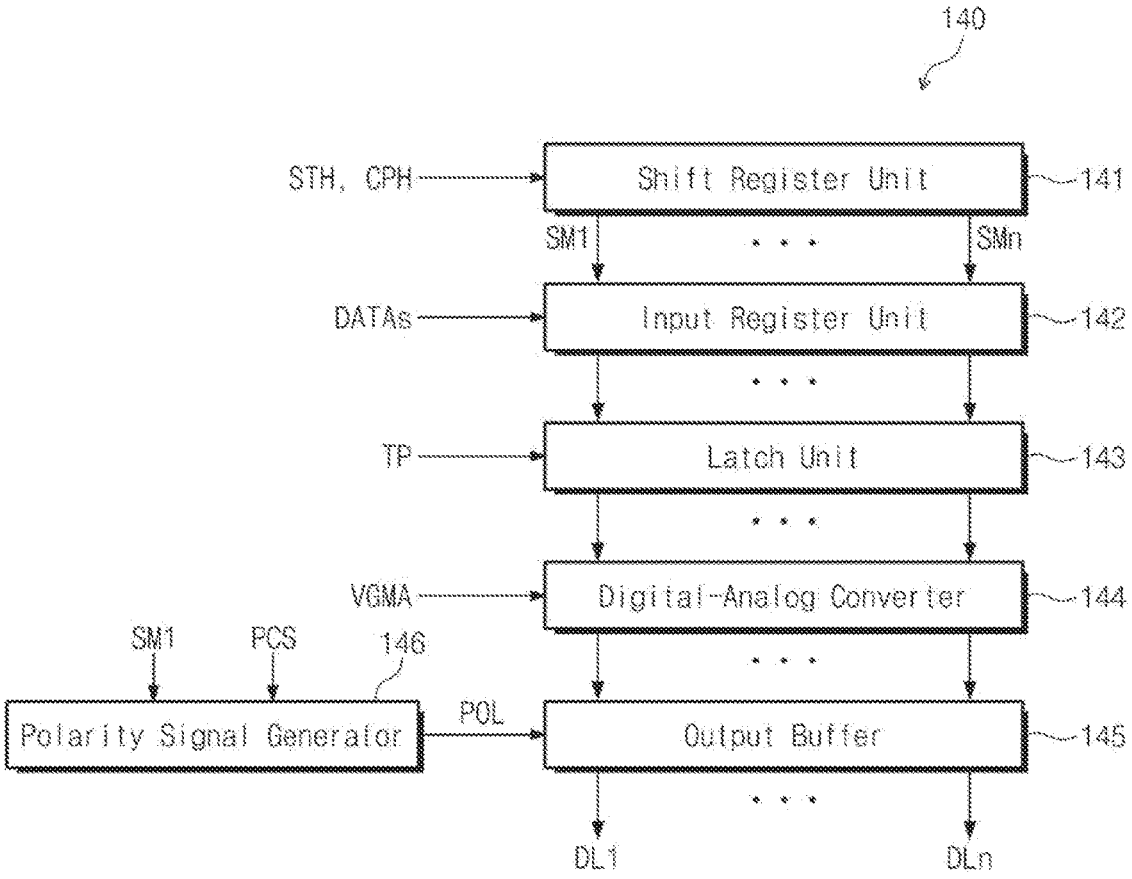
FIG. 3 is a block diagram showing an exemplary configuration of a data driver illustrated in FIG. 1.

FIG. 3 is a block diagram showing an exemplary configuration of the data driver illustrated in FIG. 1.

Referring to FIG. 3, the data driver 140 includes a shift register unit 141, an input register unit 142, a latch unit 143, a digital-analog converter 144, an output buffer 145, and a polarity signal generator 146. The shift register unit 141, the input register unit 142, the latch unit 143, the digital-analog converter 144, and the output buffer 145 may be defined as a data voltage generator for generating data voltages.

The shift register unit 141 receives a start signal STH that is a data control signal DCS, and a data synchronization clock CPH to generate a sampling signal. The shift register unit 141 shifts the data start signal STH for every one cycle of the data synchronization clock CPH to generate n number of sampling signals SM1 to SMn.

The shift register unit 141 includes n number of shift registers in order to generate the n number of sampling signals SM1 to SMn. The n number of sampling signals SM1 to SMn are supplied to the input register unit 142. Also, the first sampling signal SM1 of the n number of sampling signals SM1 to SMn is supplied to a polarity signal generator 146.

The input register unit 142 sequentially stores a plurality of pieces of image data DATAs in response to the sampling signals sequentially supplied from the shift register unit 141. The input register unit 142 stores the n number of pieces of image data DATAs corresponding to one horizontal line in response to the sampling signals. The one horizontal line is defined as one pixel row. The input register unit 142 includes n number of data input latches for latching and storing the n number of pieces of image data DATAs.

The latch unit 143 concurrently receives the plurality of pieces of image data DATAs stored in the input register unit 142 in response to a load signal TP that is the data control signal DCS, and stores the received plurality of pieces of image data DATAs. The latch unit 143 includes the same number of data storage latches as the data input latches of the input register unit 142 in order to store the plurality of pieces of image data DATAs corresponding to one horizontal line. The latch unit 143 supplies the plurality of pieces of image DATAs to the digital-analog converter 144.

The digital-analog converter 144 generates gradation display voltages corresponding to the plurality of pieces of image DATAs by using a gamma voltage VGMA received from a gamma voltage generator (not shown). The gradation display voltages are analog voltages corresponding to gradations of the plurality of pieces of image DATAs. The gradation display voltages are supplied to the output buffer 145.

The output buffer 145 amplifies the gradation display voltages received from the digital-analog converter 144 to output the amplified gradation display voltages as data voltages. The output buffer 145 determines polarities of the data voltages in response to a polarity control signal POL received from the polarity signal generator 146 and then outputs the data voltages.

The polarity signal generator 146 receives the first sampling signal SM1 from the shift register unit 141 and a pattern control signal PCS that is the data control signal DCS from the timing controller 120.

The polarity signal generator 146 generates the polarity control signal POL in response to the first sampling signal SM1 and the pattern control signal PCS, and supplies the generated polarity control signal POL to the output buffer 145.

The first sampling signal SM1 is a signal notifying an operation timing of the data driver 140. Since the polarity inversion patterns of the data voltages should be determined when the data voltages are generated, the polarity signal generator 146 receives the first sampling signal SM1 and recognizes a generation timing of the data voltages to operate.

The polarity signal generator 146 outputs the polarity control signal POL for setting the polarity patterns of the data voltages in response to the pattern control signal PCS such that pixels have the same polarity inversion pattern for every 2h number of pixels in each pixel row and have the same polarity inversion pattern every for every 2k number of pixel rows in a column direction.

The polarity signal generator 146 of the data driver 140 may set the polarity inversion patterns of the data voltages in response to the pattern control signal PCS having predetermined pattern information. More detailed configuration and operation of the polarity signal generator 146 will be described in detail below.

Figure 4:
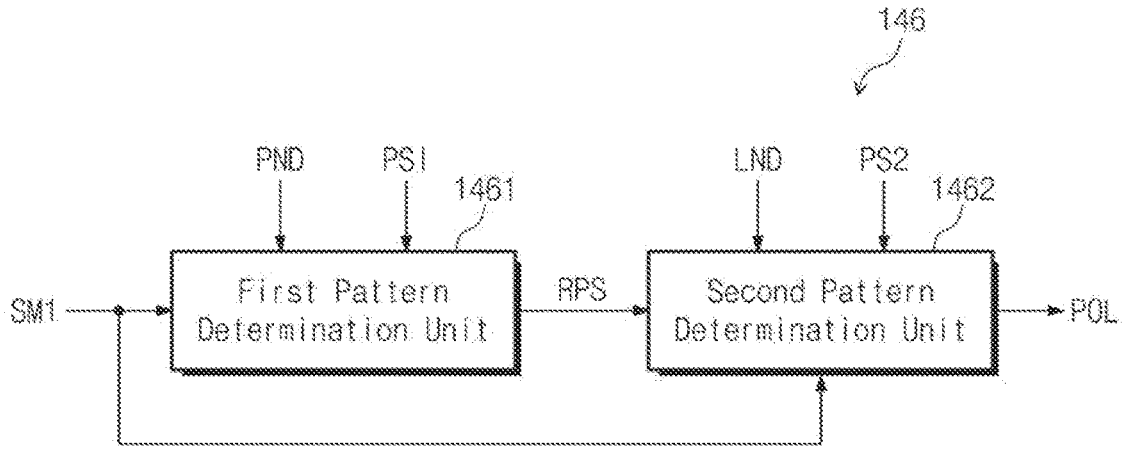
FIG. 4 is a block diagram showing an exemplary configuration of a polarity signal generator illustrated in FIG. 3.

FIG. 4 is a block diagram showing an exemplary configuration of the polarity signal generator illustrated in FIG. 3.

Referring to FIG. 4, the polarity signal generator 146 includes a first pattern determination unit 1461 and a second pattern determination unit 1462. The first pattern determination unit 1461 outputs a reference polarity signal RPS for setting polarities of the data voltages such that pixels have the same polarity inversion pattern for every 2h number of pixels in each pixel row.

The second pattern determination unit 1462 receives the reference polarity signal RPS from the first pattern determination unit 1461, sets the polarity of the reference polarity signal RPS such that pixels have the same polarity inversion pattern for every 2k number of pixel rows in the column direction, and outputs the set polarity of the reference polarity signal RPS. In this case, the data voltages may have the same polarity inversion pattern for every 2h number of pixel rows.

The pattern control signal PCS includes pixel number data PND, line number data LND, a first pattern signal PS1, and a second pattern signal PS2. The pixel number data PND includes pixel number information of one pixel row. The line number data LND includes number information of pixel rows. The first pattern signal PS1 includes polarity inversion pattern information of the 2h number of pixels. The second pattern signal PS2 includes polarity inversion pattern information of the 2k number of pixel rows.

The first pattern determination unit 1461 receives the pixel number data PND and the first pattern signal PS1. The first pattern determination unit 1461 determines polarity inversion patterns of the 2h number of pixels by using the first pattern signal PS1. Additionally, the first pattern determination unit 1461 determines the repetition number of polarity inversion patterns of the 2h number of pixels by dividing the pixel number data PND by 2h that is the number of the pixels of the first pattern signal PS1.

Specifically, the polarity inversion patterns of the 2h number of pixels in the first pattern signal PS1 may be expressed by a binary number and expressed by a two-bit (even number of bits) signal. The numerals "1" of the binary number may denote a negative polarity (−). The numerals "0" of the binary number may denote a positive polarity (+). In an exemplary embodiment, when the h is 1, the polarity inversion patterns of two pixels may be expressed by a two-bit signal according to the first pattern signal PS1, and may be set to any one of polarities of the following Table 1.

TABLE 1

| First pattern signal PS1 | Polarity |
|---|---|
| 0 0 | ++ |
| 0 1 | +− |
| 1 0 | −+ |
| 1 1 | −− |

In an exemplary embodiment, when "h" is 1, the polarity inversion patterns of four pixels may be expressed by a four-bit signal according to the first pattern signal PS1, and may be set to any one of polarities of the following Table 2.

TABLE 2

| First pattern signal PS1 | Polarity |
|---|---|
| 0 0 0 0 | ++++ |
| 0 0 0 1 | +++− |
| 0 0 1 0 | ++−+ |
| 0 0 1 1 | ++−− |
| 0 1 0 0 | +−++ |
| 0 1 0 1 | +−+− |
| 0 1 1 0 | +−−+ |
| 0 1 1 1 | +−−− |
| 1 0 0 0 | −+++ |
| 1 0 0 1 | −++− |
| 1 0 1 0 | −+−+ |
| 1 0 1 1 | −+−− |
| 1 1 0 0 | −−++ |
| 1 1 0 1 | −−+− |
| 1 1 1 0 | −−−+ |
| 1 1 1 1 | −−−− |

For example, while when "h" is 1 and 2, the first pattern signal PS1 is described in Tables 1 and 2, respectively, but the inventive concept is not limited thereto, and "h" may be set to various values.

Since pixels are connected to the n number of data lines DL1 to DLn, the number of pixels of each row is n. Therefore, the pixel number data PND is "n". Since the first pattern signal PS1 includes polarity inversion pattern information of the 2h number of pixels, the number of pixels of the first pattern signal PS1 is 2h. The first pattern determination unit 1461 divides "n" by "2h". The value obtained by dividing n by 2h is a repetition number of polarity inversion patterns of the 2h number of pixels.

The first determination unit 1461 outputs the repetition number of polarity inversion patterns of the 2h number of pixels as the reference polarity signal RPS. The reference polarity signal RPS is supplied to the second pattern determination unit 1462.

The second pattern determination unit 1462 receives the line number data LND and the second pattern signal PS2. The second pattern determination unit 1462 sets the polarity of the reference polarity signal RPS such that the pixels have the same polarity inversion pattern for every 2k number of pixel rows in the row direction by using the second pattern signal PS2 and outputs the set polarity of the reference polarity signal RPS. Additionally, the second pattern determination unit 1462 determines a repetition number of polarity inversion patterns of the 2k number of pixel rows by dividing the line number data PND by 2k that is the number of the pixel rows.

Specifically, the polarity inversion patterns of the 2k number of pixel rows in the second pattern signal PS2 may be expressed by a binary number and 2k-bits. The second pattern signal PS2 may be expressed by a binary number and an even number of bits similar to the first pattern signal PS1.

The binary digit 1 in the second pattern signal PS2 is a signal non-inverting a polarity of the reference polarity signal RPS. In addition, the binary digit 0 is a signal inverting the polarity of the reference polarity signal RPS. When the second pattern signal PS2 is the binary digit 1, polarities of the data voltages are determined as the polarity of the reference polarity signal RPS. That is, when the second pattern signal PS2 is the binary digit 0, the polarity of the reference polarity signal RPS is inverted, so that the polarities of the data voltages are determined.

Since the pixels are connected to the m number of gate lines GL1 to GLm, the number of pixel rows is m. Therefore, the line number data LND is "m". Since the second pattern signal PS2 includes polarity inversion pattern information of the 2k number of pixel rows, the number of pixel rows of the second pattern signal PS2 is 2k. The second pattern determination unit 1462 divides "n" by "2k". The value obtained by the n by the 2k is a repetition number of polarity inversion patterns of the 2k number of pixel rows.

The second determination unit 1462 outputs the polarity patterns of the 2k number of pixel rows and the repetition number of polarity inversion patterns of the 2k number of pixel rows as the polarity control signal POL. The reference polarity signal RPS is non-inverted or inverted in a predetermined pattern on the 2k number of pixel rows by the polarity control signal POL. In addition, the polarity inversion patterns of the 2k number of the pixel rows are repeated by a value obtained by dividing m by 2k.

Figure 5:
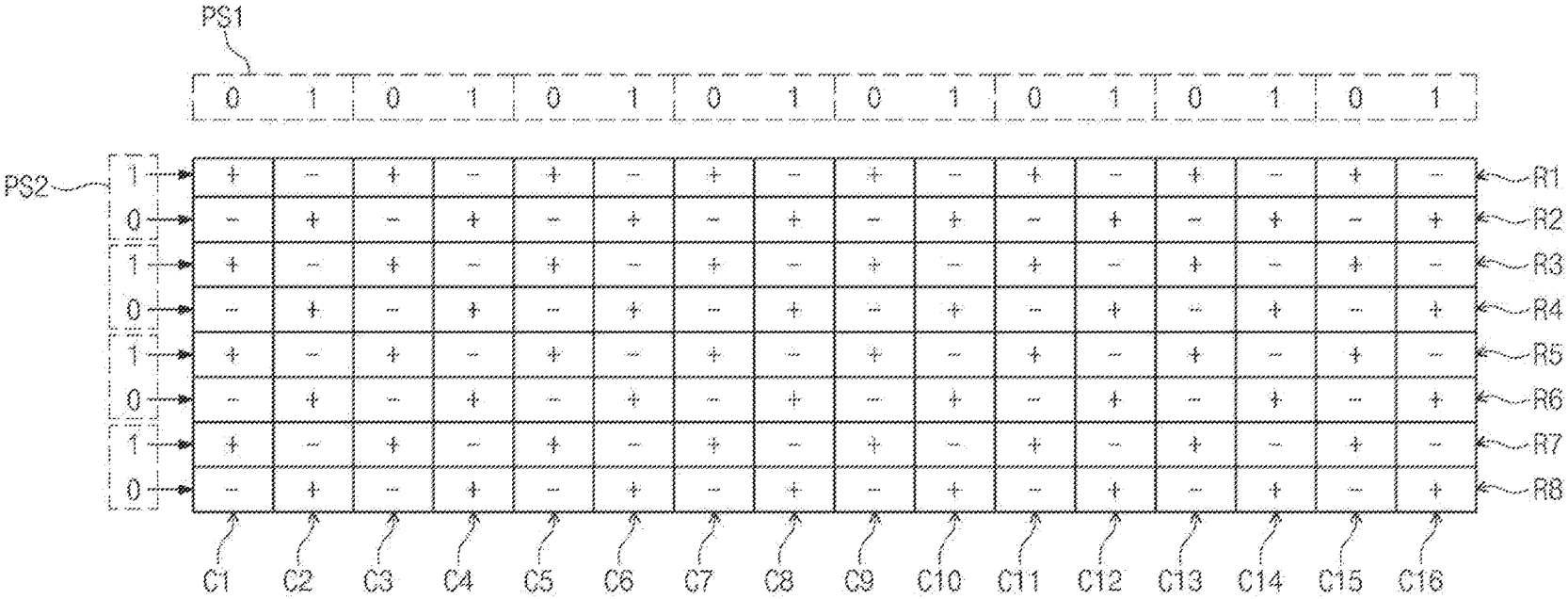
FIG. 5 and FIG. 6 are tables showing polarities of pixels according to a polarity control signal in accordance with exemplary embodiments.
Figure 6:
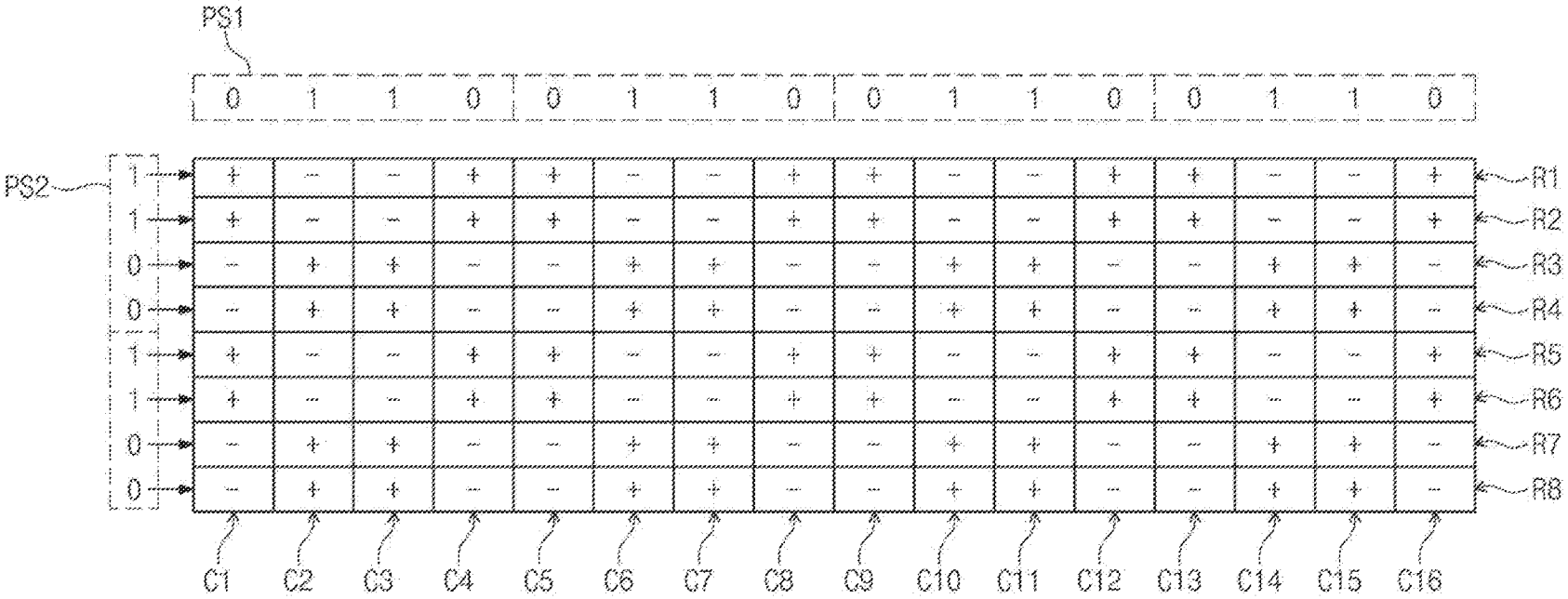

FIGS. 5 and 6 are tables showing exemplary polarities of pixels according to a polarity control signal.

The exemplary embodiments of FIGS. 5 and 6 show pixels PX that are arranged with eight columns R1 to R8 and sixteen rows C1 to C6. That is, letters m and n are 8 and 16, respectively. Therefore, the number of pixels in each of rows R1 to R8 is 16 and the number of pixel rows C1 and C6 in a column direction is 8.

The first pattern signal PS1 is disposed over the pixels PX in a row direction for convenience in description. The second pattern signal PS2 is disposed on a left side of the pixels PX in a column direction.

Referring to FIG. 5, letters k and h are all 1. The first pattern signal PS1 is a two-bit signal, and may be "0 1" as shown in FIG. 5. A value obtained by dividing n by 2h is 8. Therefore, polarities of two pixels PX are determined as a positive polarity (+) and a negative polarity (−) according to "0 1" that is the first pattern signal PS1. In addition, the reference polarity signal RPS is determined such that the polarity inversion patterns of the two pixels PX are repeated 8 times.

The second pattern signal PS2 is a two-bit signal, and may be "1 0" as shown in FIG. 5. A value obtained dividing n by 2k is 4. Therefore, polarities of two pixels PX are determined by non-inverting and inverting the reference polarity signal RPS according to "1 0" that is the second pattern signal PS2. In addition, the reference control signal POL is determined such that the polarity inversion patterns of the two pixels PX are repeated 4 times.

Accordingly, as shown in FIG. 5, data voltages having a positive polarity (+) and a negative polarity (−) obtained by non-inverting and inverting the reference polarity signal RPS in a first row R1 are repeatedly supplied to the pixels PX for every two pixels PX. Data voltages having a positive polarity (+) and a negative polarity (−) obtained by non-inverting and inverting the reference polarity signal RPS in the second row R2 are repeatedly supplied to the pixels PX for every two pixels PX. Also, polarity inversion patterns of data voltages of the first row R1 and the second row 2 are repeated for every two pixels, and resultantly, are repeated 4 times.

Referring to FIG. 6, letters k and h are all 2. The first pattern signal PS1 is a four-bit signal and may be "0 1 1 0" as shown in FIG. 6. A value obtained by dividing the n by the 2h is 4. The second pattern signal PS2 is a four-bit signal, and may be "1 1 0 0" as shown in FIG. 6. A value obtained by dividing m by 2k is 2.

Accordingly, as shown in FIG. 6, data voltages having a positive polarity (+), a negative polarity (−), a negative positive (−), and a positive polarity (+) obtained by non-inverting and inverting the reference polarity signal RPS in the first row R1 and the second row R2 are repeated for every 4 pixels to be supplied to the pixels PX 4 times.

Data voltages having a negative polarity (−), a positive polarity (+), a positive polarity (+), and a negative polarity (−) obtained by non-inverting the reference polarity signal RPS in the third row R3 and the fourth row R4 are repeated for every 4 pixels to be supplied to the pixels PX 4 times. Also, polarity inversion patterns of the first to fourth rows R1 to R4 are repeated for every four pixels, and resultantly, are repeated 4 times.

While h and k are set to the same value in FIGS. 5 and 6, h and k are not limited thereto, and may be set to different values.

In an exemplary embodiment, the timing controller 120 does not supply the polarity control signal POL for determining polarities of data voltages to the data driver 140, but supplies only predetermined pattern information to the data driver 140 through the pattern control signal PCS.

The data driver 140 sets polarity inversion patterns of the data signals in response to the pattern control signal PCS. The data driver 140 may not receive information on polarities of all data voltages, and may receive predetermined pattern information to determine the polarities of the data voltages and to, thus, easily determine the polarities of the data voltages.

As a result, the display apparatus 100 according to an exemplary embodiment of the inventive concept may easily set polarities of the data voltages.

According to an exemplary embodiment of the inventive concept, the data driver, and the display apparatus including the same, may easily set polarities of the data voltages.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A data driver comprising:

a polarity signal generator configured to output polarity control signals for setting polarity patterns of data voltages such that:

pixels have an identical polarity inversion pattern for every 2h number of pixels (where h is a natural number) in each pixel row defined by pixels that are arranged on a row in a row direction; and pixels have an identical polarity inversion pattern for every 2k number of pixel rows (where k is a natural number) in a column direction; and a data voltage generator determining polarities of the data voltages in response to the polarity control signal to provide the determined polarities of the data voltages to the pixels, wherein the polarity signal generator comprises:

a first pattern determination unit configured to set polarities of the data voltages such that the pixels have an identical polarity inversion pattern for every 2h number of pixels in each pixel row and to output the set polarities of the data voltages as a reference polarity signal; and a second pattern determination unit configured to set a polarity of the reference polarity signal such that the pixels have an identical polarity inversion pattern for every 2k number of pixel rows in the column direction and output the set polarity of the reference polarity signal as the polarity control signal.

2. The data driver of claim 1, wherein the first pattern determination unit is configured to determine the polarity inversion patterns of the 2h number of pixels in response to a first pattern signal including polarity inversion pattern information of the 2h number of pixels, divide pixel number data including pixel number information of the pixel row by the 2h to determine a repetition number of the polarity inversion patterns of the 2h number of pixels, and output the determined repetition number as the reference polarity signal.

3. The data driver of claim 2, wherein the pixel number data is an even number and is set so as to be divided by 2h.

4. The data driver of claim 2, wherein the first pattern signal is set to a binary number and a 2h-bit signal.

5. The data driver of claim 4, wherein digit 1 of the binary number corresponds to a negative polarity and digit 0 of the binary number corresponds to a positive polarity.

6. The data driver of claim 1, wherein the second pattern determination unit is configured to determine a polarity of the reference polarity signal in response to a second pattern signal including polarity inversion pattern information of the 2k number of pixel rows such that the pixels have an identical polarity pattern for the every 2k number of pixel rows in the column direction, divide line number data including pixel number information of the pixel rows by 2k to determine a repetition number of the polarity inversion patterns of the 2k number of the pixel rows, and output the determined repetition number as the polarity control signal.

7. The data driver of claim 6, wherein the line number data is an even number and is set so as to be divided by 2k.

8. The data driver of claim 6, wherein the second pattern signal is set to a binary number and a 2k-bit signal.

9. The data driver of claim 8, wherein digit 1 of the binary number is a signal non-inverting a polarity of the reference polarity signal and digit 0 of the binary number is a signal inverting the polarity of the reference polarity signal.

10. A display apparatus comprising:

pixels receiving data voltages in response to gate signals to display an image;

a gate driver supplying the gate signals to the pixels; and a data driver supplying the data voltages to the pixels, wherein the data driver comprises:

a polarity signal generator configured to output polarity control signals for setting polarity patterns of data voltages such that pixels have an identical polarity inversion pattern for every 2h number of pixels (where h is a natural number) in each pixel row defined by pixels that are arranged on a row in a row direction, and have an identical polarity inversion pattern for every 2k number of pixel rows (where k is a natural number) in a column direction; and a data voltage generator configured to determine polarities of the data voltages in response to the polarity control signal to provide the determined polarities of the data voltages to the pixels, wherein the polarity signal generator comprises:

a first pattern determination unit configured to set the polarities of the data voltages such that the pixels have an identical polarity inversion pattern for every 2h number of pixels in each pixel row and outputting the set polarities of the data voltages as a reference polarity signal; and a second pattern determination unit configured to set a polarity of the reference polarity signal such that the pixels have an identical polarity inversion pattern for every 2k number of pixel rows in the column direction and outputting the set polarity of the reference polarity signal as the polarity control signal.

11. The display apparatus of claim 10, wherein the first pattern determination unit is configured to determine the polarity inversion patterns of the 2h number of pixels in response to a first pattern signal including polarity inversion pattern information of the 2h number of pixels, divide pixel number data including pixel number information of the pixel row by 2h to determine a repetition number of the polarity inversion patterns of the 2h number of pixels, and output the determined repetition number as the reference polarity signal.

12. The display apparatus of claim 11, wherein the pixel number data is an even number and is set so as to be divided by 2h.

13. The display apparatus of claim 11, wherein the first pattern signal is set to a binary number and a 2h-bit signal where digit 1 of the binary number corresponds to a negative polarity and digit 0 of the binary number corresponds to a positive polarity.

14. The display apparatus of claim 11, wherein the second pattern determination unit is configured to determine a polarity of the reference polarity signal in response to a second pattern signal including polarity inversion pattern information of the 2k number of pixel rows such that the pixels have the same polarity pattern for the every 2k number of pixel rows in the column direction, divide line number data including pixel number information of the pixel rows by 2k to determine a repetition number of the polarity inversion patterns of the 2k number of the pixel rows, and output the determined repetition number as the polarity control signal.

15. The display apparatus of claim 14, further comprising a timing controller configured to supply the first pattern signal, the pixel number data, the second pattern signal, and the line number data to the first pattern determination unit and the second pattern determination unit.

16. The display apparatus of claim 14, wherein the line number data is an even number and is set so as to be divided by 2k.

17. The display apparatus of claim 14, wherein the second pattern signal is set to a binary number and a 2h-bit signal wherein digit 1 of the binary number is a signal non-inverting the polarity of the reference polarity signal and digit 0 of the binary number a signal inverting the polarity of the reference polarity signal.

* * * * *